US005964523A

United States Patent [19]

Eversberg

[11] Patent Number: 5,964,523

[45] Date of Patent: Oct. 12, 1999

[54] REMODEL RECESSED LIGHT FIXTURE

[75] Inventor: Gerhard Eversberg, Lüdenscheid, Germany

[73] Assignee: Erco Leuchten GmbH, Ludenscheid, Germany

[21] Appl. No.: 09/020,761

[22] Filed: Feb. 9, 1998

[30] Foreign Application Priority Data

Apr. 11, 1997 [DE] Germany ..... 197 15 068

[51] Int. Cl.[6] ..... F21V 21/04

[52] U.S. Cl. ..... 362/365; 362/148

[58] Field of Search ..... 362/147, 148, 362/364, 365, 366, 368

[56] References Cited

U.S. PATENT DOCUMENTS

| | | | |
|---|---|---|---|
| 2,966,325 | 12/1960 | Pascucci | 362/366 |
| 2,973,177 | 2/1961 | Stubbs | 362/366 |
| 3,018,083 | 1/1962 | Bobrick | 362/365 |
| 5,077,650 | 12/1991 | Cestari | 362/365 |
| 5,331,531 | 7/1994 | Unger et al. | 362/365 |
| 5,609,414 | 3/1997 | Caluori | 362/366 |

FOREIGN PATENT DOCUMENTS

| | | | |
|---|---|---|---|
| 484226 | 6/1952 | Canada | 362/365 |
| 33 29 794 | 2/1985 | Germany . | |

*Primary Examiner*—Alan Cariaso
*Attorney, Agent, or Firm*—Herbert Dubno; Andrew Wilford

[57] ABSTRACT

A recessed light fixture adapted to be installed in a hole in a ceiling panel having an exposed lower face and an opposite upper face has a frame bearing on the front face and engaged upward through the hole in the panel and a reflector mounted in the frame generally above the panel. A screw extending along an axis transverse to the panel is axially fixed in the frame above the panel, rotatable about the axis, and has an external screwthread. A retaining pawl is pivotal on the screw above the panel between an outer position projecting outward past the frame and an inner position and is displaceable axially along the screw downward toward the panel and upward away from the panel. A spring engaged between the pawl and the screw couples the pawl to the screw and is positioned to permit the pawl to move axially only downwardly relative to the screw. A cam on the frame forces the pawl into the outer position on downward axial displacement toward the panel.

10 Claims, 3 Drawing Sheets

REMODEL RECESSED LIGHT FIXTURE

FIELD OF THE INVENTION

The present invention relates to a recessed light fixture. More particularly this invention concerns such a fixture adapted for remodel use, that is which can be installed through a finished ceiling when there is no access from above.

BACKGROUND OF THE INVENTION

A standard recessed light fixture adapted to be installed in a hole in a ceiling panel having an exposed lower face and an opposite upper face has as disclosed in German patent document 3,329,794 of Demmin a frame bearing on the front face and engaged upward through the hole in the panel and a reflector mounted in the frame generally above the panel. A screw extending along an axis transverse to the panel is axially fixed in the frame above the panel, rotatable about the axis, and has an external screwthread. A plurality of retaining pawls above the panel can each move between an outer position projecting outward past the frame and an inner position and are each displaceable axially along the screw downward toward the panel and upward away from the panel.

Thus such a fixture is installed by moving the pawls into the inner position and then pushing the frame through a hole in the panel. The pawls are then moved into the outer positions and the screws rotated to bring the pawls down into snug engagement with the top back face of the ceiling panel (although it would be perfectly possible within the scope of this invention to mount such a fixture through a vertical wall panel). The frame is thus left solidly mounted on the panel so that the reflector, which normally is removed for installation, can be fitted into the frame and then a finish ring can be installed around the edge of the opening to complete the installation.

In German patent document 2,915,545 of Grimm a system is shown where the pawls are pivotal between the inner and outer positions and engage via a spring on the screw. Thus the pawls are pivoted into the outer position and the springs can be slid along the pawls to initially set them. Thereafter the screw is rotated to tighten them in place. With such an arrangement it is difficult for the user to ascertain if the pawls are fully in the outer position, especially as the actuating arm used to pivot them is fairly fragile so that if the pawl hits an obstruction this arm bends easily.

OBJECTS OF THE INVENTION

It is therefore an object of the present invention to provide an improved remodel-type recessed light fixture.

Another object is the provision of such an improved remodel-type recessed light fixture which overcomes the above-given disadvantages, that is which is easy to install and, if necessary, remove, and that is of simple construction.

SUMMARY OF THE INVENTION

A recessed light fixture adapted to be installed in a hole in a ceiling panel having an exposed lower face and an opposite upper face has according to the invention a frame bearing on the front face and engaged upward through the hole in the panel and a reflector mounted in the frame generally above the panel. A screw extending along an axis transverse to the panel is axially fixed in the frame above the panel, rotatable about the axis, and has an external screwthread. A retaining pawl is pivotal on the screw above the panel between an outer position projecting outward past the frame and an inner position and is displaceable axially along the screw downward toward the panel and upward away from the panel. A spring engaged between the pawl and the screw couples the pawl to the screw and is positioned to permit the pawl to move axially only downwardly relative to the screw. A cam on the frame forces the pawl into the outer position on downward axial displacement toward the panel.

Thus the pawls are pivoted out of the way as the fixture is being installed, but as they are pulled down onto the top of the ceiling panel they are automatically cammed into the outer positions. They cannot accidentally swing back in during the installation operation.

The spring according to the invention is a leaf spring fixed in the pawl and having an arm forming with the axis a downwardly open acute angle. The arm has an outer end formed with a notch engaging the screw. Thus it has a ratchet action, allowing the spring to be slid with its pawl down the screw for initial setting of the fixture. If further tightening is desired the screw is turned to force the spring, like a nut, down further and thereby solidly clamp the ceiling panel between the frame and the pawl. Of course opposite rotation of the screw loosens the pawls and can even allow them to be backed up far enough for removal of the fixture.

In accordance with the invention a torque spring is engaged between the screw and the pawl and urges the pawl into the outer position. Normally two such pawls are pivotal on the screw and the torque spring is mounted on the screw and has opposite legs engaging the respective pawls. This torque spring has a central loop engaged around the screw. Furthermore the pawls have interleaved arms axially coupling them together and axially traversed by the screw. These pawls are pivotal independently of each other and the coupling spring is mounted on only one of the pawls.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
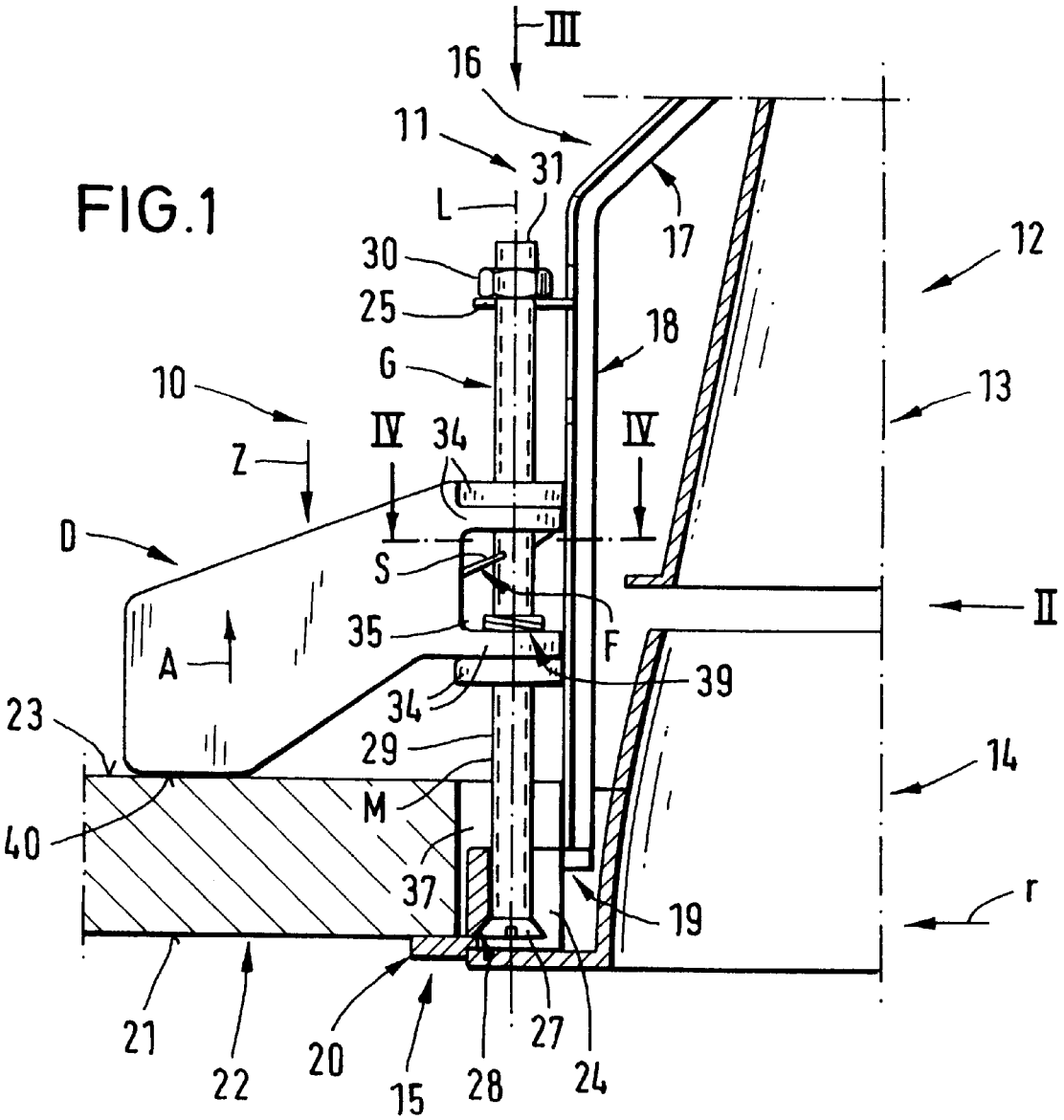
FIG. 1 is a vertical section through a side of an installed recessed light fixture according to the invention.

As seen in the drawing, a recessed light fixture 10 according to the invention has a frame 11 that holds a reflector 12 formed by a pair of rotation-symmetrical reflector parts or rings 13 and 14 that could of course also be polygonal, e.g. square. The frame 11 has an annular ring 15 bridged by a plurality of members 16 to which the reflector 12 is secured by unillustrated fasteners. Each member 16 is a bar having an upper angled part 17 joined centrally of the fixture 10 with the other angled parts 17 and lower parts 18 extending perpendicular to a ceiling panel 22 having a lower front face 21, an upper back face 23, and a circular hole 37 through which the fixture 10 is installed. The lower parts 18 are secured at 19 to the ring 15. This ring 15 has a flange 20 that lies against the lower panel face 21.

A screw 26 has a head 27 seated in a cutout 24 of the ring 15 and extends through an anchor flange or tab 25 projecting horizontally from the respective lower part 18. The screw 26 has an axis L that is normally vertical and perpendicular to the panel 22, parallel to the respective part 18. Its head 27 engages an abutment 28 on the ring 15, it has a screwthread 29, and carries a nut 30 fixed on its upper end 31 above the tab 25. The nut 30 could be replaced by another element such as a plastic acorn cap, a cotter pin, or the like. These screws 26 are installed by inserting the end 31 of the screw's shaft G through the tab 25 and then setting its head 27 in the cutout 24 in a radial direction r.

Figure 2:
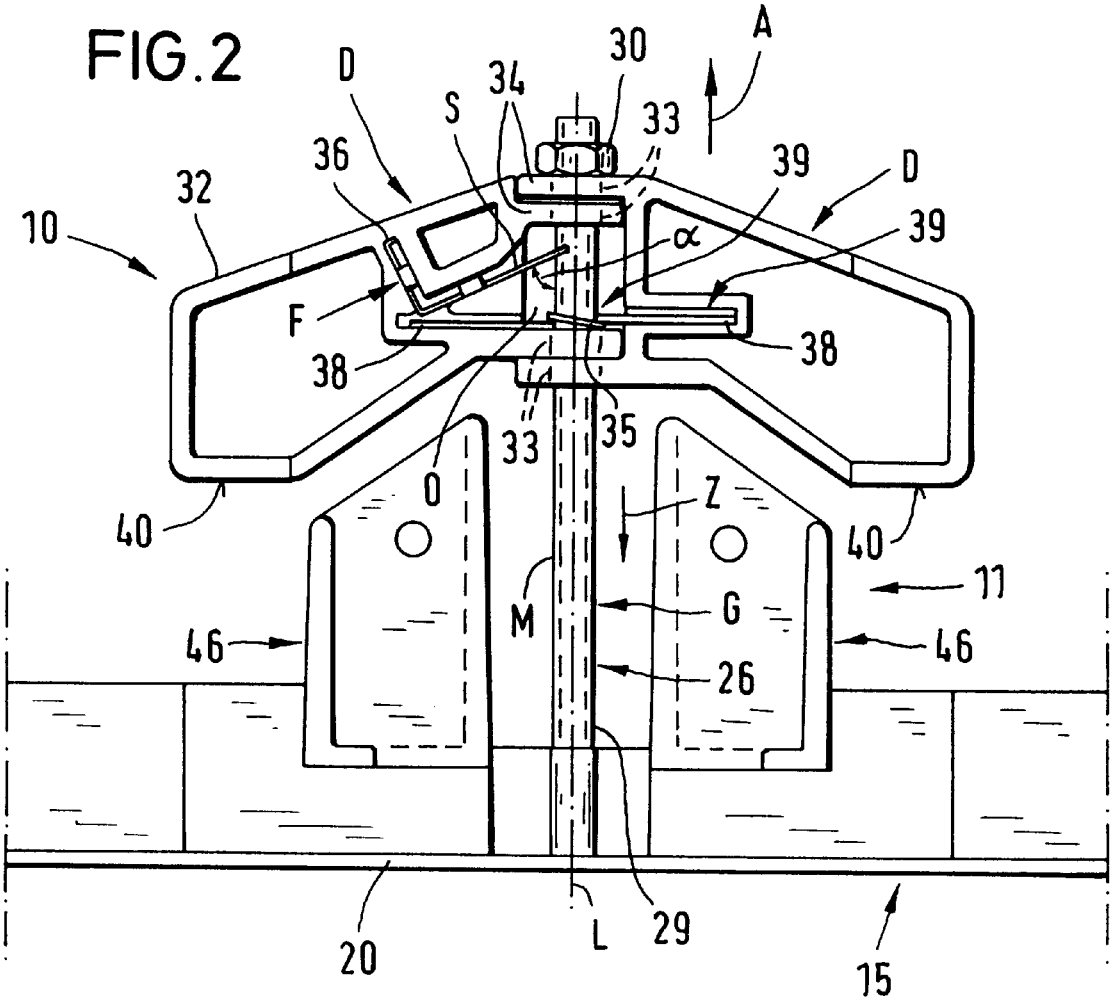
FIG. 2 is a side view taken in the direction of arrow II of FIG. 1 with some parts removed for clarity of view.

Each screw 26 carries a pair of similar retaining pawls D having arms 34 formed with bores 33 that fit around the screw 26 for pivoting of these pawls D about the respective screw axis L. In addition each screw 26 passes through a central loop 35 of a torsion spring 39 whose arms S engage in slots 38 of the two pawls D to urge them continuously as shown by arrows v into the outer position shown in FIGS. 1 and 3. FIG. 2 shows the inner position.

Figure 4:
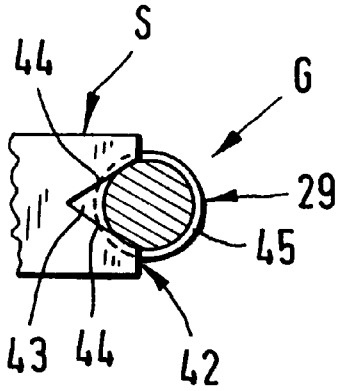
FIG. 4 is a section taken along line IV—IV of FIG. 1.

One side 32 of one of the pawls D has a seat 36 for an L-shaped leaf spring F having an arm S that engages a surface M of the shaft G at an angle $\alpha$ whose open angle O is directed axially in downward axial direction Z. Thus this arm S engages in the screwthread 26 of the shaft G and its angle $\alpha$ ensures that the two interconnected pawls D can with the screw 26 stationary move axially in the direction Z but not in the opposite axial direction A. To this end as shown in FIG. 4 the spring arm S is formed with an end 42 having a V-shaped notch 43 in turn having a pair of flanks 44 that engage between turns 45 of the screwthread 29.

Figure 3:
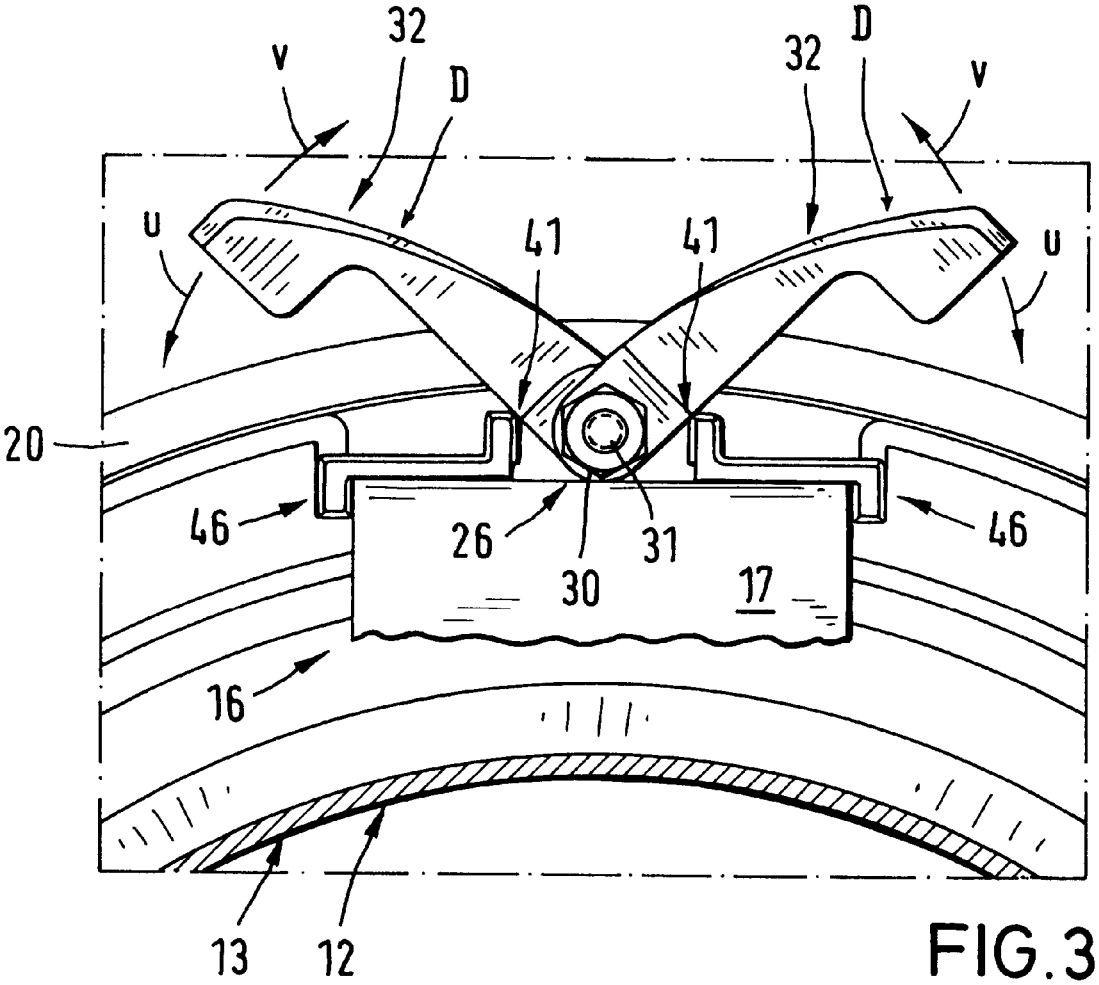
FIG. 3 is a top view taken in the direction of arrow III of FIG. 1.

The frame ring 15 is fitted at each of the screws 26 with a cam 46 having an angled edge 41 oriented such that as the pawls D move downward in direction Z they are cammed outward, that is rotationally toward each other, into the outer position as shown in FIG. 3. Each such edge 41 has a height or length measured in the direction Z that is at least equal to the thickness of the thickest possible ceiling panel 22 that is likely to be encountered.

To install the light fixture 10 the user manually pulls in the pawls D in direction U to the inner position and pushes the entire frame 15, after removal of course of the reflector 12, through the hole 37 in the ceiling panel 22. Once all the way through the hole the pawls D are released so they pivot out in direction v under the force of the spring 39. Then the pawls D, whose arms 34 interlock so they move axially together, are pushed down in direction Z until their lower faces 40 engage the back face 23 of the ceiling panel 22. As they move downward, the cams 46 will ensure that they remain in the desired outer positions and will in fact make it impossible for them to move back in direction u.

If the pawls D need to be tighter, the screw 26 is rotated to in effect screw down the spring F and thereby force down the pawls D. Similarly to loosen the fixture 10, so it can be repositioned or removed, the screws 26 are oppositely rotated to walk the springs F up the screws 26. Once the pawls D have moved up past the cams 46, they can be swung back into their inner positions.

I claim:

1. A recessed light fixture adapted to be installed in a hole in a ceiling panel having an exposed lower face and an opposite upper face, the light fixture comprising:

a frame bearing on the exposed lower face and engaged upward through the hole in the panel;

a reflector mounted in the frame generally above the panel;

a screw extending along an axis transverse to the panel, axially fixed in the frame above the panel, rotatable about the axis, and having an external screwthread;

a retaining pawl pivotal on the screw above the panel between an outer position projecting outward past the frame and an inner position and displaceable axially along the screw downward toward the panel and upward away from the panel;

a coupling spring engaged between the pawl and the screw, coupling the pawl to the screw, and positioned to permit the pawl to move axially only downwardly relative to the screw; and means including a cam on the frame for forcing the pawl into the outer position on downward axial displacement toward the panel.

2. The recessed light fixture defined in claim 1 wherein the spring is a leaf spring fixed in the pawl and having an arm forming with the axis a downwardly open acute angle.

3. The recessed light fixture defined in claim 2 wherein the arm has an outer end formed with a notch engaging the screw.

4. The recessed light fixture defined in claim 1, further comprising a torque spring engaged between the screw and the pawl and urging the pawl into the outer position.

5. The recessed light fixture defined in claim 1 wherein two such pawls are pivotal on the screw and the torque spring is mounted on the screw and has opposite legs engaging the respective pawls.

6. The recessed light fixture defined in claim 5 wherein the torque spring has a central loop engaged around the screw.

7. The recessed light fixture defined in claim 5 wherein the pawls have interleaved arms axially coupling the pawls together and axially traversed by the screw.

8. The recessed light fixture defined in claim 7 wherein the pawls are pivotal independently of each other.

9. The recessed light fixture defined in claim 5 wherein the coupling spring is mounted on only one of the pawls.

10. The recessed light fixture defined in claim 1 wherein the cam has an edge engageable with the retaining pawl only in the outer position thereof, the edge having an overall height measured parallel to the axis that is greater than a thickness of the panel measured parallel to the axis.

* * * * *